US009580943B1

(12) United States Patent
Amerling et al.

(10) Patent No.: US 9,580,943 B1
(45) Date of Patent: Feb. 28, 2017

(54) COWLS AND LATCHING DEVICES FOR OUTBOARD MARINE ENGINES

(71) Applicant: Brunswick Corporation, Lake Forest, IL (US)

(72) Inventors: Steven J. Amerling, Fond du Lac, WI (US); Brad J. Van Ruiswyk, Waupun, WI (US); Bradley R. Stafford, Omro, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 14/871,298

(22) Filed: Sep. 30, 2015

(51) Int. Cl.

| | |
|---|---|
| ***B63H 20/00*** | (2006.01) |
| ***B63H 20/32*** | (2006.01) |
| ***E05C 3/14*** | (2006.01) |
| ***E05C 3/12*** | (2006.01) |

(52) U.S. Cl.
CPC ..... *E05C 3/145* (2013.01); *B63H 20/32* (2013.01); *E05C 3/12* (2013.01)

(58) Field of Classification Search
CPC ..... B63H 20/00; B63H 20/32
USPC ..... 440/77
See application file for complete search history.

(56) References Cited

U.S. PATENT DOCUMENTS

| | | | | | |
|---|---|---|---|---|---|
| 2,549,483 | A * | 4/1951 | Kiekhaefer | B63H 20/10 | 123/195 P |
| 2,549,485 | A * | 4/1951 | Kiekhaefer | B63H 20/10 | 123/195 P |
| 3,773,010 | A * | 11/1973 | Elingsen | F02B 61/045 | 123/195 P |
| 4,348,194 | A * | 9/1982 | Walsh | F02B 61/045 | 123/195 P |
| 4,600,396 | A * | 7/1986 | Crane | F02B 61/045 | 292/247 |
| RE32,620 | E * | 3/1988 | Iwai | F02B 61/045 | 123/195 P |
| 4,832,641 | A * | 5/1989 | Oishi | F02B 61/045 | 123/195 P |
| 4,844,031 | A * | 7/1989 | Boda | F02B 61/045 | 123/195 P |

(Continued)

FOREIGN PATENT DOCUMENTS

| | | |
|---|---|---|
| JP | 04024192 | 1/1992 |
| JP | 04231286 | 8/1992 |

*Primary Examiner* — Lars A Olson
*Assistant Examiner* — Jovon Hayes
(74) *Attorney, Agent, or Firm* — Andrus Intellectual Property Law, LLP

(57) ABSTRACT

A latching device is for a cowl on an outboard marine engine, the cowl having first and second cowl portions that are separated from each other in an open cowl position and that are latched together by the latching device in a closed cowl position. A retainer is adapted to be fixed to the first cowl portion and a latch is adapted to be fixed to the second cowl portion. The latch is movable into and between a latched position in which the latch is latched to the retainer and an unlatched position in which the latch is unlatched from the retainer. The latch comprises an engagement member, a bell crank, and a spring that is coupled to the engagement member and the bell crank. Movement of the bell crank with respect to the engagement member generates an overcenter force on the engagement member that facilitates latching and unlatching of the engagement member and the retainer.

20 Claims, 7 Drawing Sheets

(56) References Cited

U.S. PATENT DOCUMENTS 4,875,883 A * 10/1989 Slattery ..... F02B 61/045 123/195 P
4,927,194 A * 5/1990 Wagner ..... E05C 3/045 292/106
5,102,358 A * 4/1992 Binversie ..... B63H 20/08 440/53
5,120,248 A * 6/1992 Daleiden ..... B63H 20/32 292/202
5,509,836 A * 4/1996 Ogasawara ..... B63H 20/00 440/76
5,868,591 A * 2/1999 Kleeman ..... B63H 20/00 114/172
6,059,619 A * 5/2000 Nozue ..... B63H 20/245 440/88 C
6,390,865 B1 * 5/2002 Kameoka ..... F02B 61/045 440/53
6,488,552 B2 * 12/2002 Kitsu ..... F02B 61/045 440/77
6,669,517 B1 * 12/2003 Alby ..... F02B 61/045 123/195 P
6,682,379 B1 * 1/2004 Walczak ..... B63H 20/32 123/195 P
6,899,579 B1 * 5/2005 Bruestle ..... B63H 20/002 440/77
7,201,623 B1 * 4/2007 Krupp ..... B63H 20/32 440/77
7,210,973 B2 * 5/2007 Sanschagrin ..... F02B 61/045 123/195 C
7,267,592 B1 * 9/2007 Ingebritson ..... B63H 20/32 123/195 P
7,448,928 B2 * 11/2008 Hasegawa ..... B63H 20/32 292/113
7,621,791 B2 * 11/2009 Yazaki ..... F02F 7/0082 440/77
2003/0054708 A1 * 3/2003 Yoshioka ..... B63H 20/08 440/53

* cited by examiner

COWLS AND LATCHING DEVICES FOR OUTBOARD MARINE ENGINES

FIELD

The present disclosure relates to outboard marine engines and more particularly to cowls and latching devices for cowls for outboard marine engines.

BACKGROUND

U.S. Pat. No. 4,348,194 is incorporated herein by reference in entirety and discloses a cowl for the power head of an outboard motor that includes two bottom cowl members attached together by screws which also mount a latch bracket and a hinge member. The latch bracket supports a latch mechanism which, with the hinge member serves to hold a top cowl member in place.

SUMMARY

This Summary is provided to introduce a selection of concepts that are further described herein below in the Detailed Description. This Summary is not intended to identify key or essential features of the claimed subject matter, nor is it intended to be used as an aid in limiting the scope of the claimed subject matter.

A latching device is for a cowl on an outboard marine engine, the cowl having first and second cowl portions that are separated from each other in an open cowl position and that are latched together by the latching device in a closed cowl position. A retainer is adapted to be fixed to the first cowl portion and a latch is adapted to be fixed to the second cowl portion. The latch is movable into and between a latched position in which the latch is latched to the retainer and an unlatched position in which the latch is unlatched from the retainer. The latch comprises an engagement member, a bell crank, and a spring that is coupled to the engagement member and the bell crank. Movement of the bell crank with respect to the engagement member generates an overcenter force on the engagement member that facilitates latching and unlatching of the engagement member and the retainer.

BRIEF DESCRIPTION OF THE DRAWINGS

The present disclosure is described with reference to the following Figures. The same numbers are used throughout the figures to reference like features and like components.

DETAILED DESCRIPTION OF THE DRAWINGS

Figure 1:
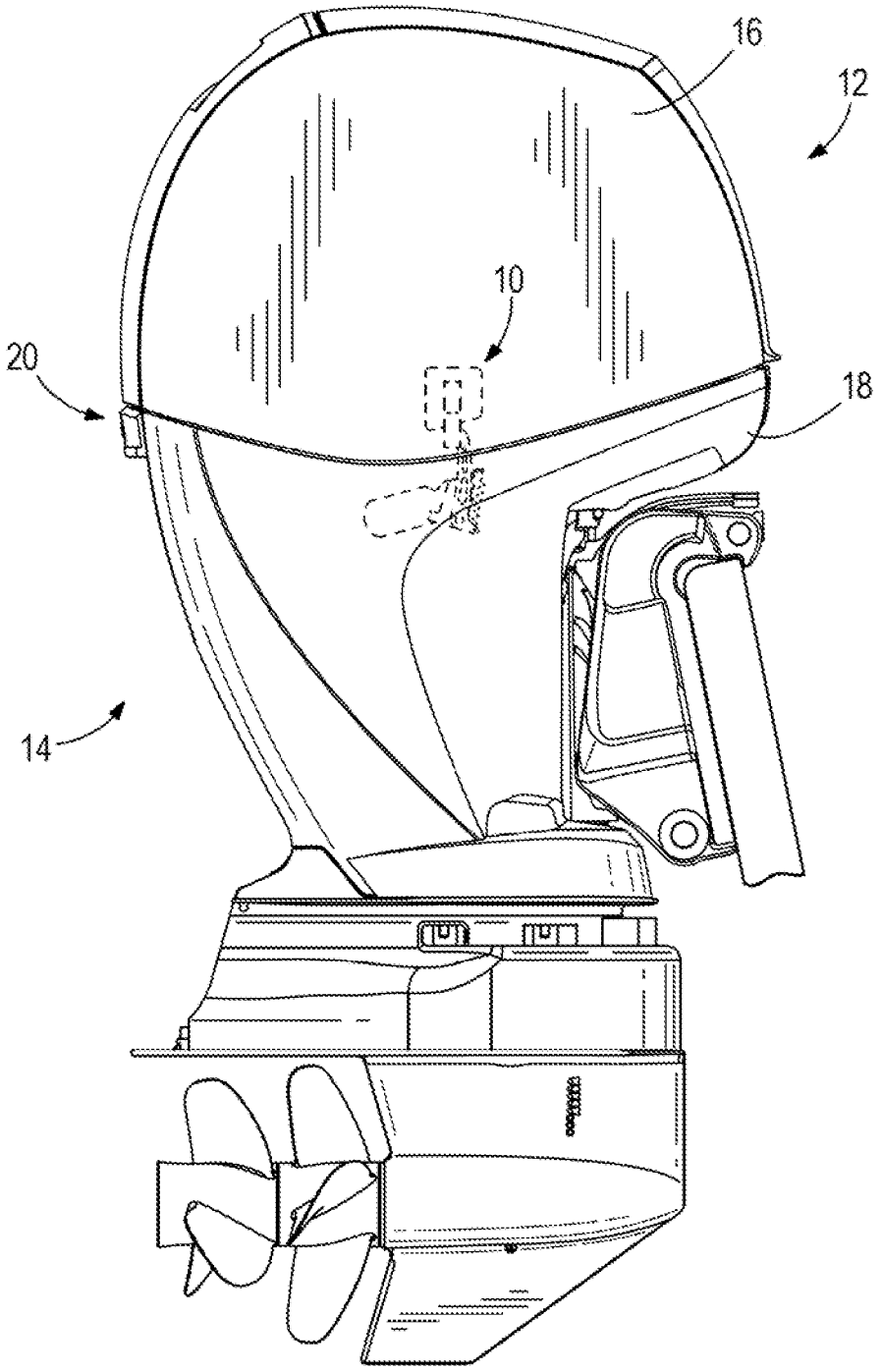
FIG. 1 is a side view of an outboard marine propulsion device having a cowl held in a closed cowl position by a latching device shown in dashed lines.

FIG. 1 depicts a latching device 10 for a cowl 12 on an outboard marine engine 14. The cowl 12 has first and second cowl portions 16, 18 that are separated from each other in an open cowl position (not shown) and that are latched together by the latching device 10 in a closed cowl position (FIG. 1). The type and configuration of the cowl 12 and outboard marine engine 14 can vary from that which is shown in the figures. In the illustrated example, the first cowl portion 16 is a top cowl and the second cowl portion 18 is a lower cowl or "chaps"; however the latching device 10 could also be arranged so that the first cowl portion 16 is the lower cowl and the second cowl portion 18 is the top cowl.

Figure 2:
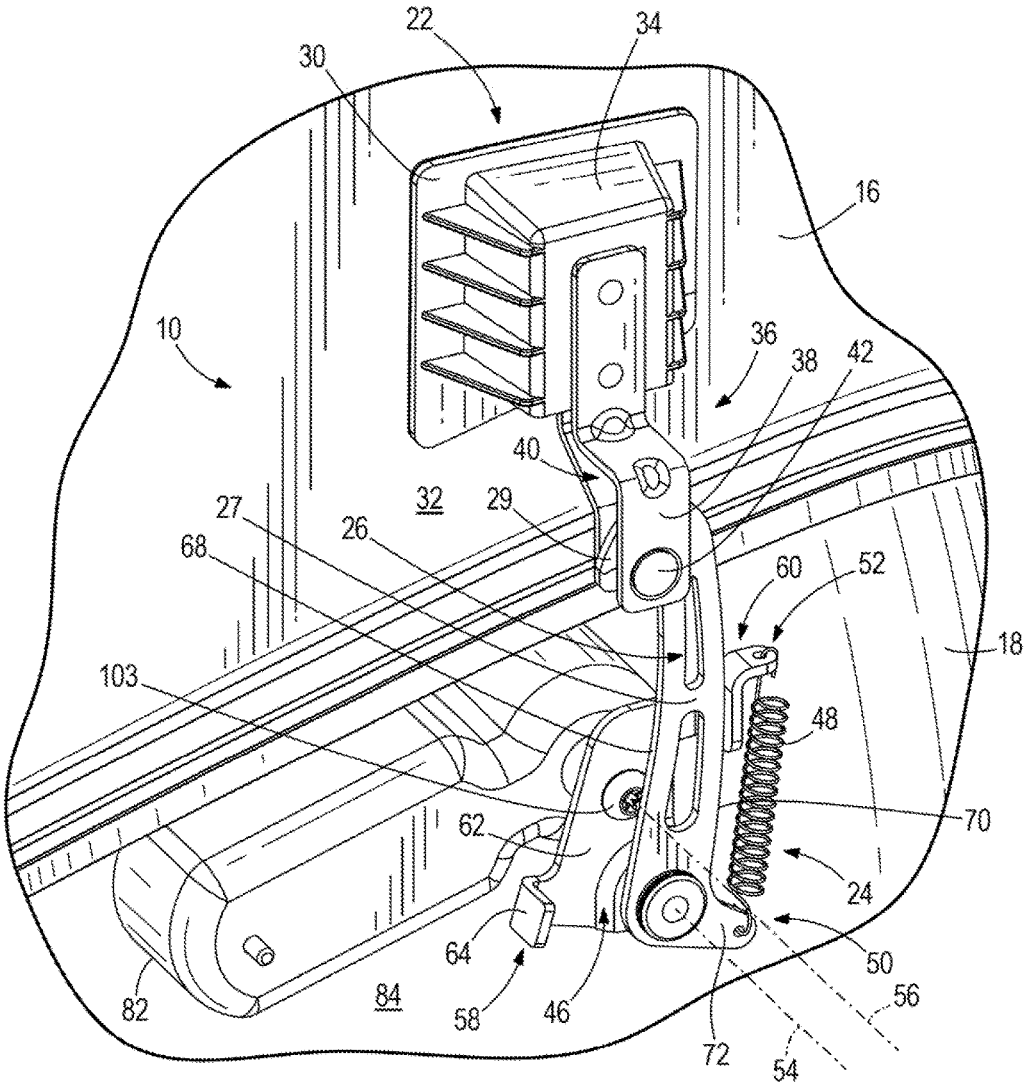
FIG. 2 is a perspective view of the latching device on the interior of the cowl.
Figure 3:
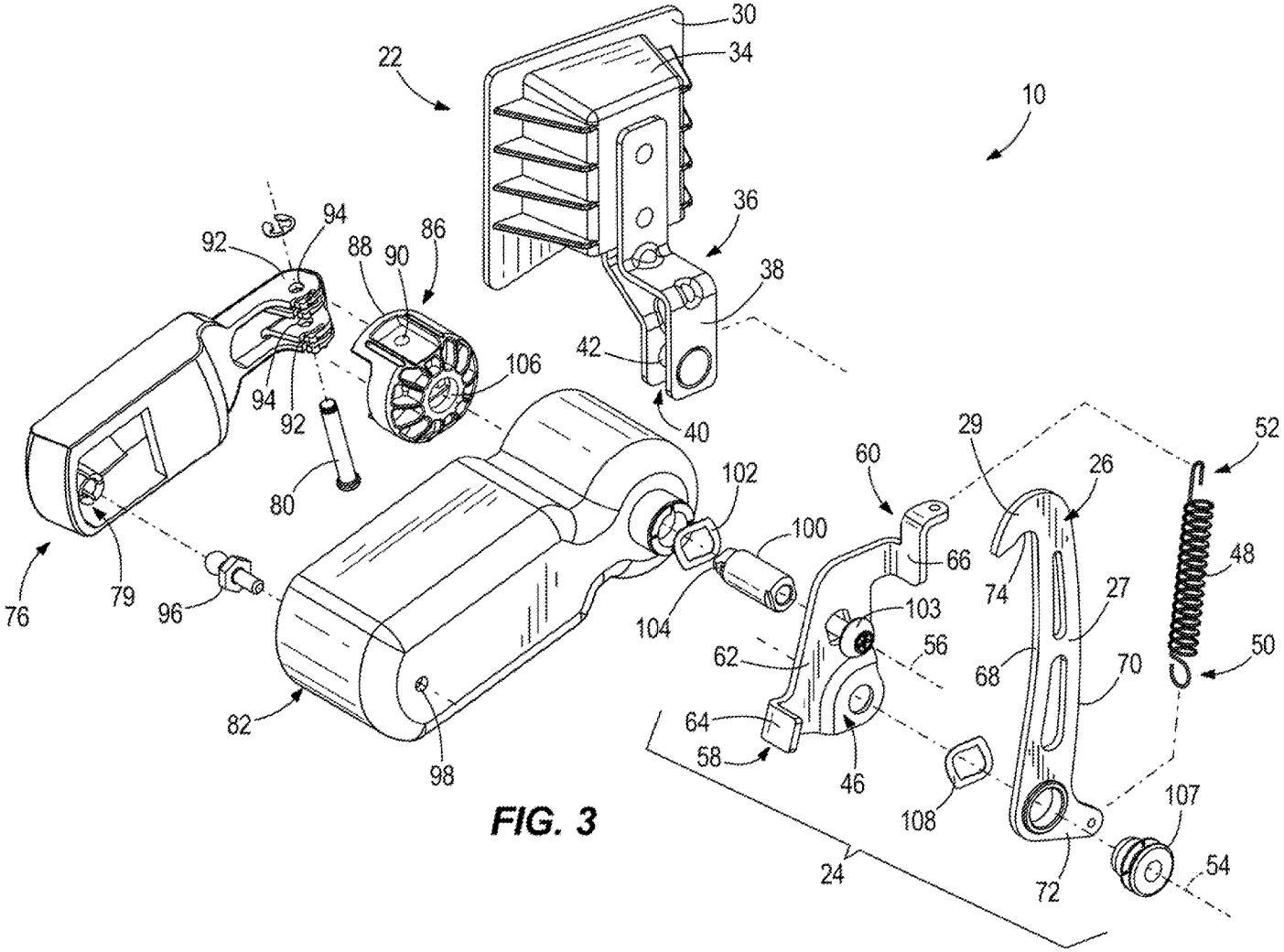
FIG. 3 is an exploded perspective view of the latching device.
Figure 4:
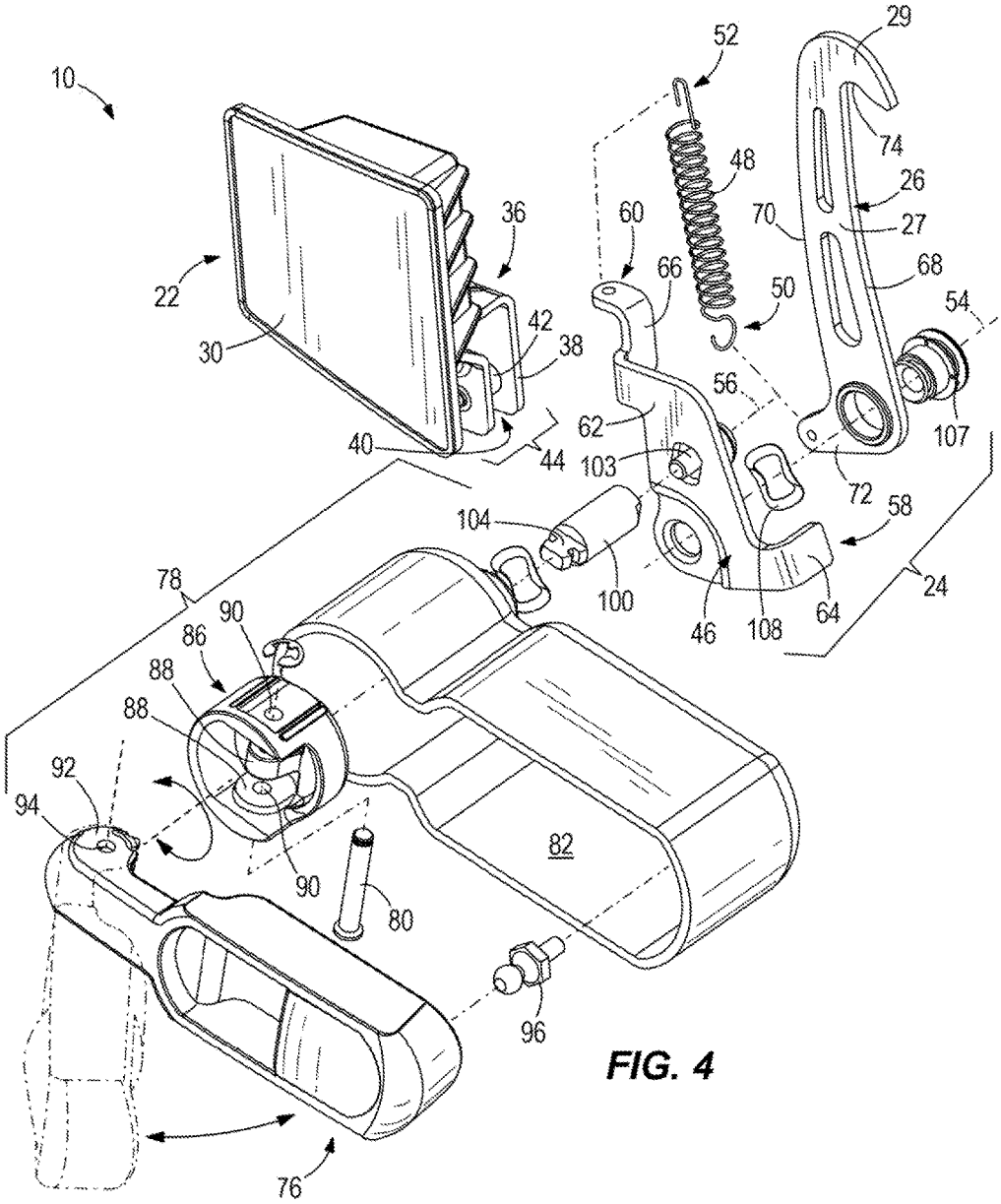
FIG. 4 is another exploded perspective view of the latching device.

Referring to FIGS. 2-4, the latching device 10 has a retainer 22 that is affixed to the first cowl portion 16 and a latch 24 that is affixed to the second cowl portion 18. The latch has an engagement member 26 that is rotatable into and between a latched position (FIG. 2) in which the engagement member 26 is engaged with the retainer 22 to retain the first and second cowl portions 16, 18 in the closed cowl position and an unlatched position (FIG. 5) in which the engagement member 26 is disengaged from the retainer 22 to allow movement of the first and second cowl portions 16, 18 into the open cowl position. As described further herein below with reference to FIGS. 5-9, the latch 24 is uniquely configured such that an overcenter force acts on the engagement member 26 as the latch 24 is moved from the unlatched position to the latched position and vice versa. Advantageously, the overcenter force assists the engagement member 26 towards the unlatched and latched positions.

The type and configuration of the retainer 22 can vary from that which is shown. In the illustrated example, the retainer 22 includes a base plate 30 that is affixed to an interior surface 32 of the first cowl portion 16. The retainer 22 further includes a mounting block 34 on the base plate 30 and a mounting bracket 36 on the mounting block 34. The mounting block 34 and mounting bracket 36 can be formed together or as different components. The mounting bracket 36 includes a pair of aligned offset bracket portions 38, 40 and a supporting shaft 42 that extends between the pair of aligned offset bracket portions 38, 40 such that a gap 44 (see FIG. 4) exists therebetween. The gap 44 allows for passage of the engagement member 26 into and out of engagement with the supporting shaft 42, as will be described further herein below.

In addition to the engagement member 26, the latch 24 includes a bell crank 46 that causes and assists rotation of the engagement member 26 into and out of the latched position and unlatched position. The latch 24 also has a coil spring 48 with a first end 50 that is coupled to the engagement member 26 and a second end 52 that is coupled to the bell crank 46. The coil spring 48 has a natural resiliency so that the coil spring 48 tends to axially contract. The concepts herein disclosed are not limited to arrangements having a coil spring. For example, spring 48 can instead be a torsion spring.

The engagement member 26 rotates about an engagement member axis of rotation 54. The bell crank 46 rotates about a bell crank axis of rotation 56. At certain points, the engagement member 26 translates about the bell crank axis of rotation 56 as the bell crank 46 rotates about the bell crank axis of rotation 56. The engagement member axis of rotation 54 and the bell crank axis of rotation 56 are parallel to each other and are laterally spaced apart from each other. The engagement member 26 has an elongated engagement arm 27 and a transverse end 29 that engages with and disengages from the retainer 22, as will be further described herein below. The engagement member 26 has opposing first and second curved engagement surfaces 68, 70. The engagement member 26 along the transverse end 29 has an inner engagement surface 74 (see FIGS. 3 and 4) that transversely extends relative to the first engagement surface 68.

The bell crank 46 has a first engagement portion 58 that engages with and assists rotation of the engagement member 26 as the bell crank 46 is rotated about the bell crank axis of rotation 56 in an unlatching direction (compare FIGS. 9 through 5; as further discussed herein below). The bell crank 46 further has a second engagement portion 60 that engages with and retains the engagement member 26 in the latched position as the bell crank 46 is rotated with respect to the engagement member 26 about the bell crank axis of rotation 56 in an opposite, latching direction (compare FIGS. 5 through 9; as further discussed herein below), wherein the engagement member 26 is safely held in place, as will be described further herein below. The exact configuration of the bell crank 46 can vary from that which is shown. In the illustrated example, the bell crank 46 includes a plate 62. The first engagement portion 58 includes a first flange 64 that transversely extends relative to the plate 62. The second engagement portion 60 includes a second flange 66 that transversely extends relative to the plate 62. The first and second flanges 64, 66 are disposed on opposite sides of the plate 62 with respect to the engagement member 26 and in use engage with the first and second curved engagement surfaces 68, 70, respectively. The first end 52 of the coil spring 48 is attached to the second engagement portion 60 of the bell crank 46. The opposite, second end 50 of the coil spring 48 is attached to a lateral extension 72 of the engagement member 26.

As further described herein below with respect to FIGS. 5-9, rotation of the bell crank 46 in the latching direction (shown at arrow 110) initially causes the bell crank 46 and engagement member 26 to rotate together, due to the resiliency of the coil spring 48, until the first engagement surface 68 abuts the supporting shaft 42. Continued rotation of the bell crank 46 in the latching direction causes the bell crank 46 to translate with respect to the engagement member 26, as the first engagement surface 68 slides down along the supporting shaft 42, until the inner engagement surface 74 engages with the supporting shaft 42 and the second flange 66 abuts the second curved engagement surface 70. Conversely, comparing FIGS. 9-5, rotation of the bell crank 46 in the opposite unlatching direction initially causes the inner engagement surface 74 to separate from the supporting shaft 42 on the retainer 22 while the first engagement surface 68 slides upwardly along and continues to abut the supporting shaft 42. Continued rotation of the bell crank 46 in the unlatching direction causes the first engagement portion 58 to engage the first engagement surface 68 of the engagement member 26 and thus cause the engagement member 26, including the inner engagement surface 74 and the first engagement surface 68, to rotate away from the supporting shaft 42 of the retainer 22 about the bell crank axis of rotation 56. In the unlatched position, the resiliency of the coil spring 48 tends to maintain relative positions of the bell crank 46 and engagement member 26, as shown in FIG. 5.

Rotation of the latch 24 can be caused by various known arrangements. In the illustrated example, which is unique, the latching device 10 has a handle 76 that is attached to the bell crank 46 along the bell crank axis of rotation 56 such that rotation of the handle 76 about the bell crank axis of rotation 56 causes rotation of the bell crank 46 about the bell crank axis of rotation 56. The handle 76 is attached to the bell crank 46 by a unique handle retainer assembly 78 (FIG. 4). The handle retainer assembly 78 is configured such that the handle 76 is movable (in the illustrated example, pivotable) into and between a rotationally fixed position (see e.g. FIG. 4; solid line) wherein the handle 76 is prevented from rotating about the bell crank axis of rotation 56 and a rotatable position (see e.g. FIG. 4; phantom line) wherein the handle 76 is rotatable about the bell crank axis of rotation 56. The handle 76 is pivotable about a handle pivot shaft 80 that extends transversely to the bell crank axis of rotation 56. A handle retainer 82 is formed in or attached to the interior surface 84 of the second cowl portion 18. The handle retainer 82 houses the handle 76 when the handle 76 is in the noted rotationally fixed position. The handle 76 is pivoted about the handle pivot shaft 80 to remove the handle 76 from the handle retainer 82 (FIG. 4; phantom line). A clevis housing 86 supports opposite ends of the handle pivot shaft 80. The clevis housing 86 has clevis ears 88 that each has a throughbore 90 that receives a respective end of the handle pivot shaft 80. The handle 76 has handle ears 92 that each has a throughbore 94 that receive a respective end of the handle pivot shaft 80. An axial alignment pin 96 is secured in aperture 98 of handle retainer 82. Formed in the handle 76 is a snap-fit retainer 79 that receives the ball end of the axial alignment pin 96 in a snap fit and thus aligns and secures position of the handle 76 with respect to the handle retainer 82.

Referring to FIGS. 2 and 3, a bell crank pivot shaft 100 axially extends along the bell crank axis of rotation 56 and connects the bell crank 46 to the handle 76 via the clevis housing 86 such that the handle 76, clevis housing 86, bell crank pivot shaft 100 and bell crank 46 rotate together about the bell crank axis of rotation 56 when the handle 76 is rotated about the bell crank axis of rotation 56. A fastener 103 connects the bell crank 46 to the bell crank pivot shaft 100 such that the bell crank 46 and bell crank pivot shaft 100 rotate together about the bell crank axis of rotation 56. A Bellville washer 102 is disposed between the opposite end of the bell crank pivot shaft 100 and the handle retainer 82. The Belleville washer 102 has curvatures that tend to axially separate the bell crank 46 from the handle retainer 82 and thus allowing free rotation of the bell crank 46 with respect to the handle retainer 82. A T-shaped or flanged extension 104 axially extends from the end of the bell crank pivot shaft 100 and is received in a complementary shaped recess 106 formed in the clevis housing 86 such that the clevis housing 86 and associated handle 76 rotate together with the bell crank pivot shaft 100 and bell crank 46 about the bell crank axis of rotation 56. A bushing fastener 107 connects the engagement member 26 to the bell crank 46 along the engagement member axis of rotation 54. A Bellville washer 108 is disposed between the engagement member 26 and the bell crank 46. The Bellville washer 108 has curvatures that tend to axially separate the engagement member 26 and the bell crank 46 so that the bell crank 46 and engagement member 26 are freely rotatable with respect to each other about the engagement member axis of rotation 54.

Figure 5:
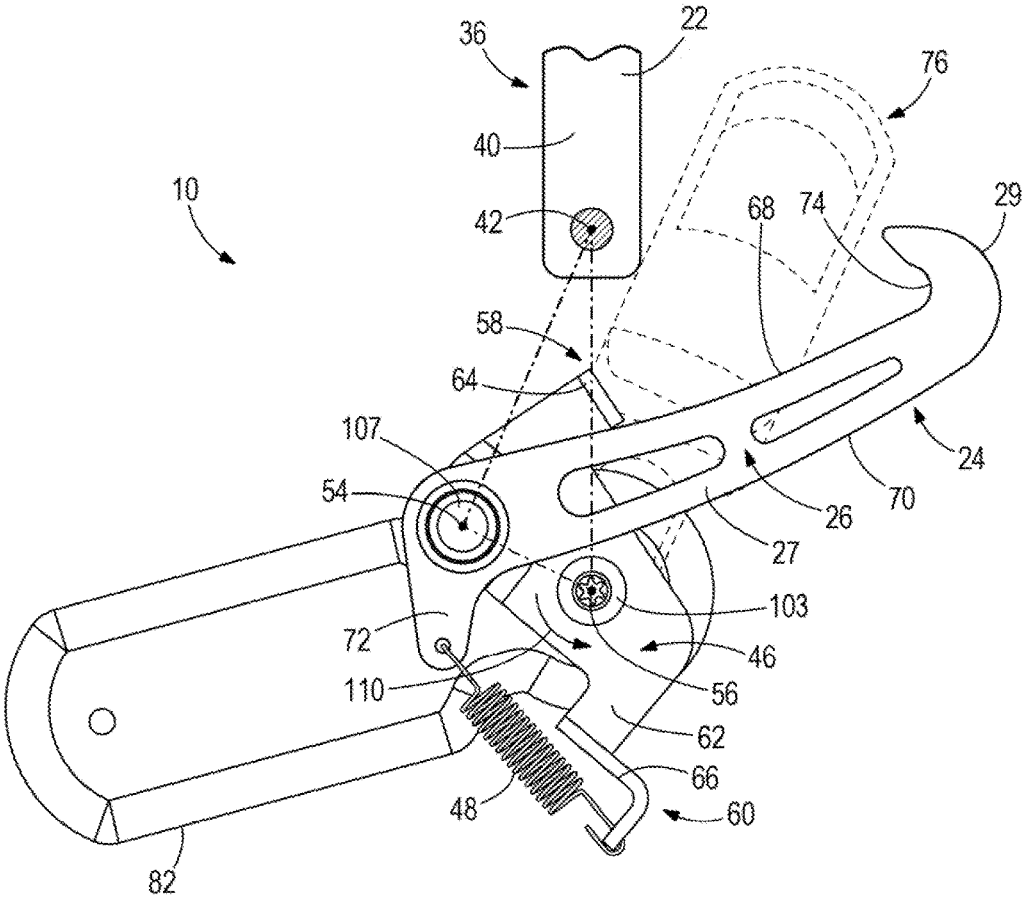
FIGS. 5-9 are side views of the latching device showing movement of the latching device from an unlatched position (FIG. 5) to a latched position (FIG. 9).
Figure 6:
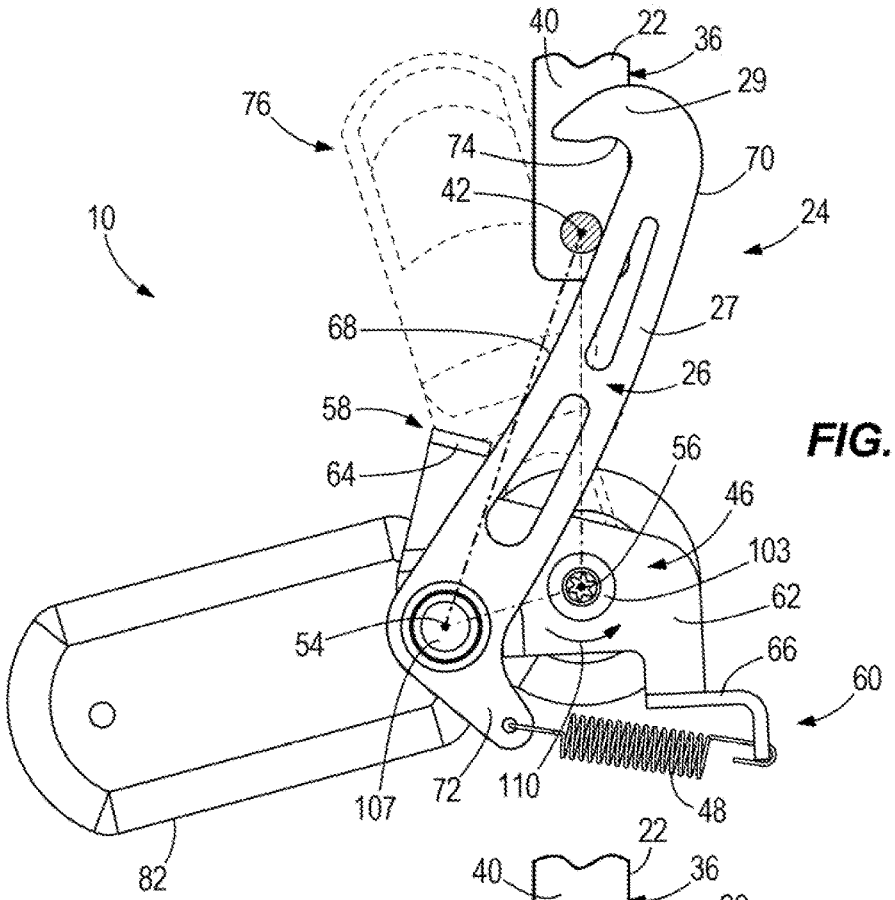
Figure 7:
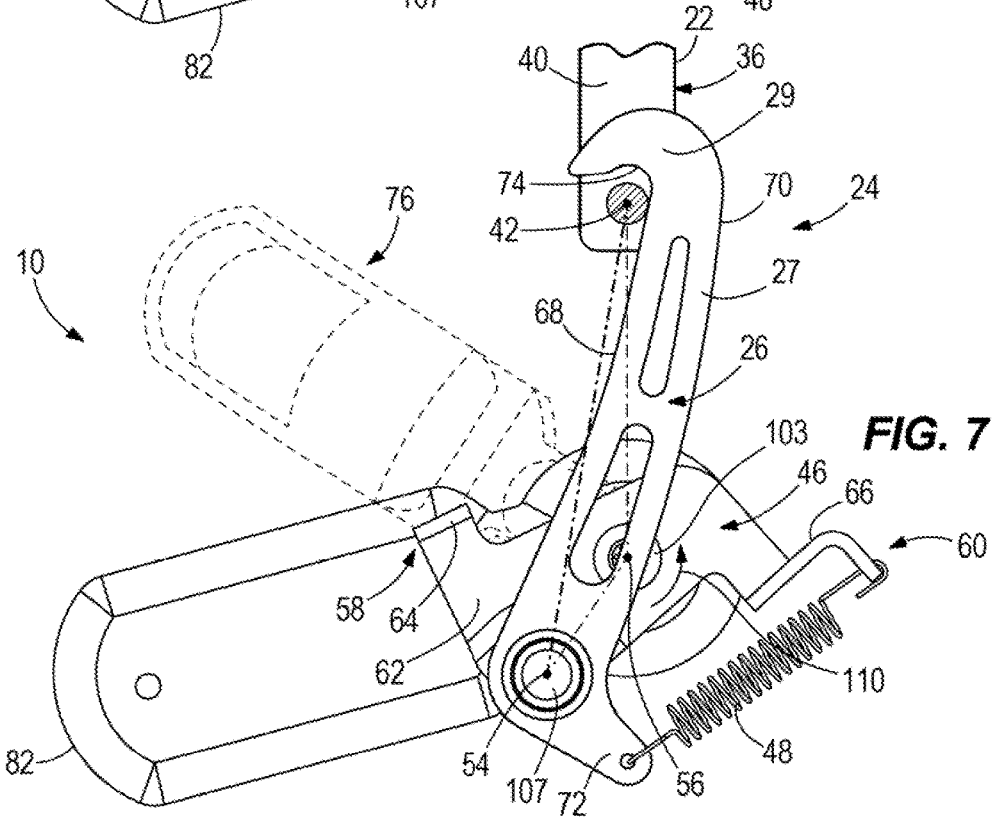
Figure 8:
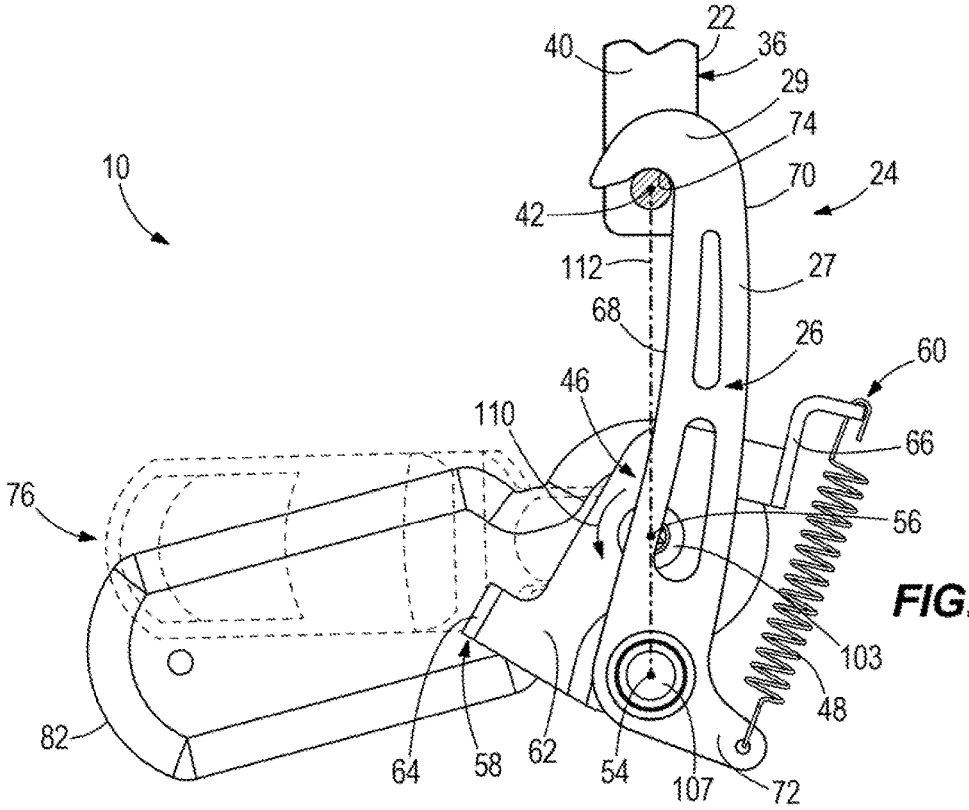
Figure 9:
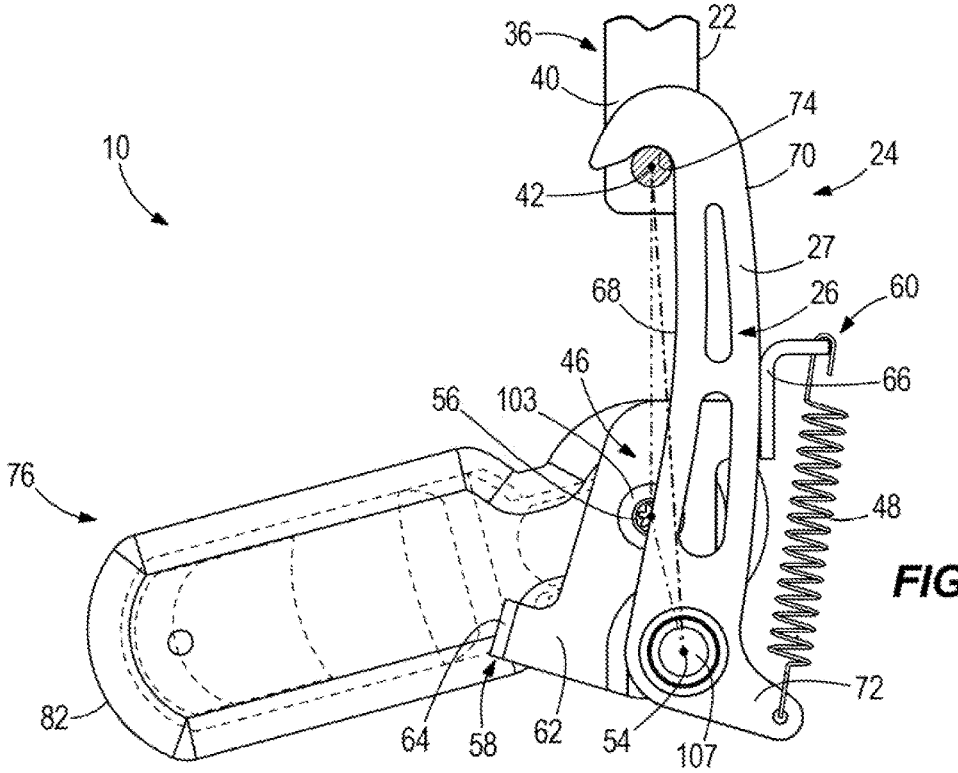

Referring now to FIGS. 5-9, movement of the latching device 10 will be described. FIG. 5 depicts the latching device 10 in the unlatched position and FIG. 9 depicts the latching device 10 in the latched position. FIGS. 6-8 depict movement of the latching device 10 from the unlatched position to the latched position. The handle 76 is shown in dashed lines. Comparing FIG. 5 to FIG. 6, to initiate latching of the latching device 10, the handle 76 when viewed from inside the cowl 12 as shown in FIG. 5, is rotated in the counterclockwise direction, as shown at arrow 110, about the bell crank axis of rotation 56, which in turn causes counterclockwise rotation of the bell crank pivot shaft 100 and bell crank 46. Due to the tendency of the coil spring 48 to retract, the engagement member 26 rotates along with the bell crank 46 in the counterclockwise direction about the bell crank axis of rotation 56 until the first engagement surface 68 engages with the supporting shaft 42, as shown in FIG. 6. Now comparing FIG. 6 to FIG. 7, continued rotation of the handle 76 in the counterclockwise direction causes continued counterclockwise rotation of the bell crank pivot shaft 100 and bell crank 46, however the supporting shaft 42 prevents further counterclockwise rotation of the engagement member 26. Thus as the bell crank 46 is rotated about axis 56, the coil spring 48 is caused to extend as the distance between the second engagement portion 60 and the lateral extension 72 increases. Further counterclockwise rotation of the bell crank 46 with respect to the engagement member 26 translates the engagement member axis of rotation 54 with respect to the bell crank axis of rotation 56, which causes the coil spring 48 to further extend, and the engagement member 26 to move with respect to the supporting shaft 42 (downwardly in the figure) such that the first engagement surface 68 slides downwardly along the supporting shaft 42. As shown by comparison of FIG. 7 to FIG. 8, further counterclockwise rotation of the handle 76 causes the first engagement surface 68 to continue to slide along the supporting shaft 42 until the inner engagement surface 74 engages with the supporting shaft 42, as shown in FIG. 8. At this point, the bell crank 46 is in a centered position. Thereafter, as shown by comparison of FIGS. 8 and 9, continued rotation of the handle 76 in the counterclockwise direction 110 causes the bell crank pivot shaft 100 and bell crank 46 to rotate relative to the engagement member 26 until the second engagement portion 60 including the second flange 66 engages with the second engagement surface 70 of the engagement member 26.

FIG. 9 thus depicts the bell crank 46 and engagement member 26 in an overcenter position. The overcenter position shown in FIG. 9 corresponds to the closed cowl position shown in FIG. 1. In the closed cowl position, separating forces on the first and/or second cowl portions 16, 18 tend to separate the first and second cowl portions 16, 18. These separating forces can be caused by for example the natural resiliency of a conventional gasket seal disposed between the first and/or second cowl portions 16, 18 or by some other bumper and/or similar structure. The separating forces cause the latching device 10 to stay in the overcenter position shown in FIG. 9, such that the overcenter force retains the latching device 10 in the latched position. This advantageously safely retains the latching device 10 in the latched position, wherein the inner engagement surface 74 is engaged with the supporting shaft 42 and the second flange 66 of the bell crank 46 abuts the second curved engagement surface 70 of the engagement member 26. Opposite rotation of the handle 76 is required to overcome the overcenter force and thus unlatch the latching device.

Comparing FIGS. 5 and 6, initial rotation of the handle 76, bell crank pivot shaft 100 and bell crank 46 in the direction of arrow 110 also causes rotation of the engagement member 26, which is attached to the bell crank 46 at the bushing fastener 107 and via the coil spring 48. The resiliency of the coil spring 48 causes the bell crank 46 and engagement member 26 to rotate together about the bell crank pivot shaft 100. As shown by comparison of FIGS. 6 and 7, engagement of the engagement member 26 with the supporting shaft 42 prevents the engagement member 26 and bell crank 46 from rotating together, which causes extension of the coil spring 48, as described herein above. As shown by comparison of FIGS. 6, 7 and 8, the bell crank 46 moves toward the centered position, shown in FIG. 8, wherein the bell crank axis of rotation 56 is disposed linearly between the engagement member axis of rotation 54 and supporting shaft 42, as shown at line 112. As shown by comparison of FIGS. 8 and 9, continued counterclockwise rotation of the handle 76 moves the bell crank axis of rotation 56 past and out of alignment with the supporting shaft 42 and engagement member axis of rotation 54 and into the noted overcenter position.

As discussed herein above, in the latched position, the handle 76 is pivoted about the handle pivot shaft 80 to insert the handle 76 into the handle retainer 82 until the ball end of axial alignment pin 96 extends through and snap-fit engages with the retainer 79, thus securing the handle 76 in place.

It will be understood by one having ordinary skill in the art that the latching procedure described herein above with reference to FIGS. 5-9 is undertaken in reverse order to unlatch latching device 10. It will be understood by one having ordinary skill in the art that as the handle 76 is rotated in the clockwise direction (opposite the arrow 110), the coil spring 48 contracts and helps retain the engagement member 26 and bell crank 46 in the position shown in FIGS. 5 and 6.

The present disclosure thus provides a cowl 12 and a latching device 10 for a cowl 12 on an outboard marine engine 14, the cowl 12 having first and second cowl portions 16, 18 that are separated from each other in an open cowl position and that are latched together by the latching device 10 in a closed cowl position. In certain examples, the latching device 10 includes a retainer 22 adapted to be fixed to the first cowl portion 16 and a latch 24 adapted to be fixed to the second cowl portion 18. The latch 24 is movable into and between a latched position (FIG. 9) in which the latch 24 is latched to the retainer 22 and an unlatched position (FIG. 5) in which the latch 24 is unlatched from the retainer 22. The latch 24 includes an engagement member 26, a bell crank 46, and a spring 48 that is coupled to the bell crank 46 and the engagement member 26. Movement of the latch 24 towards the latched position causes the engagement member 26 to engage the retainer 22 (FIG. 6). Further movement of the latch 24 towards the latched position causes the bell crank 46 to move with respect to the engagement member 26, which causes the engagement member 26 to latch to the retainer 22 (FIGS. 7-9). Movement of the latch 24 away from the latched position causes the bell crank 46 to move the engagement member 26, which causes the engagement member 26 to unlatch from the retainer 22 (compare FIGS. 9-7). Further movement of the latch 24 away from the latched position causes the engagement member 26 to separate from the retainer 22 (FIG. 5).

The bell crank 46 rotates about the bell crank axis of rotation 56. The engagement member 26 rotates about the engagement member axis of rotation 54. The engagement member axis of rotation 54 and bell crank axis of rotation 56 are parallel to each other and are laterally spaced apart from each other (see FIG. 2). Movement of the bell crank 46 with respect to the engagement member 26 acts against the spring 48 as the bell crank 46 passes by a centered position (see FIG. 8, dashed line). The spring 48 acts to retain the bell crank 46 and engagement member 26 in a rotational position with respect to each other (e.g. FIG. 5 and FIG. 9) when the latch 24 is in the unlatched position and in the latched position. In certain examples, the spring 48 can be a coil spring that has a first end 50 coupled to the engagement member 26 and a second end 52 coupled to the bell crank 46. In other examples the spring 48 can be a torsion spring and/or the like.

Separation forces between the first cowl portion 16 and the second cowl portion 18 keep the latching device 10 in the latched position (FIG. 9).

Advantageously, the latching device 10 allows a greater stroke and reduces handle load when compared to the prior art. The bell crank 46 provides a relatively large amount of stroke as it starts its pull-down motion (typically low load) and then creates a mechanical advantage at the centered position (FIG. 8). Advantageously, the bell crank 46 creates the desired motion of the engagement member 26 and provides redundant safety locking mechanisms via the overcenter force along with allowing for a large pull-down motion and low, smooth force. Advantageously, the latching device 10 has a long draw combined with low effort to provide improved latching and a smoother feel than the prior art.

Advantageously the latching device 10 provides a safety locking mechanism via locking engagement between the handle 76 and axial alignment pin 96 and abutment of engagement surface 70 against flange 66 of the bell crank 46.

In the above description, certain terms have been used for brevity, clarity, and understanding. No unnecessary limitations are to be inferred therefrom beyond the requirement of the prior art because such terms are used for descriptive purposes and are intended to be broadly construed. The different systems and method steps described herein may be used alone or in combination with other systems and methods. It is to be expected that various equivalents, alternatives and modifications are possible within the scope of the appended claims.

What is claimed is:

1. A latching device for a cowl on an outboard marine engine, the cowl having first and second cowl portions that are separated from each other in an open cowl position and that are latched together by the latching device in a closed cowl position, the latching device comprising:

a retainer adapted to be fixed to the first cowl portion;

a latch adapted to be fixed to the second cowl portion;

wherein the latch is movable into and between a latched position in which the latch is latched to the retainer and an unlatched position in which the latch is unlatched from the retainer;

wherein the latch comprises an engagement member, a bell crank, and a spring that is coupled to the bell crank and the engagement member;

wherein movement of the latch towards the latched position causes the engagement member to engage the retainer, and wherein further movement of the latch towards the latched position causes the bell crank to move with respect to the engagement member, which causes the engagement member to latch to the retainer;

wherein movement of the latch away from the latched position causes the bell crank to move the engagement member, which causes the engagement member to unlatch from the retainer, and wherein further movement of the latch away from the latched position causes the engagement member to separate from the retainer; and wherein movement of the bell crank with respect to the engagement member generates an overcenter force on the engagement member that facilitates latching and unlatching of the engagement member and the retainer.

2. The latching device according to claim 1, wherein the bell crank rotates about a bell crank axis of rotation; wherein the engagement member rotates about an engagement member axis of rotation; and wherein the engagement member axis of rotation and the bell crank axis of rotation are parallel to each other and are laterally spaced apart from each other.

3. The latching device according to claim 2, wherein movement of the bell crank with respect to the engagement member acts against the spring as the bell crank passes by a centered position to an overcenter position wherein separating forces on the first and second cowl portions retain the latch in the latched position.

4. The latching device according to claim 3, wherein the spring acts to retain the bell crank and engagement member in a rotational position with respect to each other when the latch is in the unlatched position.

5. The latching device according to claim 4, wherein the spring is a coil spring that has a first end coupled to the bell crank and a second end coupled to the engagement member, wherein movement of the bell crank with respect to the engagement member extends the spring as the bell crank passes by the centered position.

6. The latching device according to claim 2, wherein the bell crank comprises a first engagement portion that engages with and causes rotation of the engagement member about the bell crank axis of rotation as the bell crank is rotated about the bell crank axis of rotation away from the latched position and wherein the bell crank comprises a second engagement portion that engages with the engagement member and retains the engagement member against the retainer when the bell crank is rotated into the latched position.

7. The latching device according to claim 6, wherein the bell crank comprises a plate and wherein the first engagement portion comprises a first flange that transversely extends relative to the plate and wherein the second engagement portion comprises a second flange that transversely extends relative to the plate, and wherein the first and second flanges are disposed on opposite sides of the engagement member and engage with opposite first and second engagement surfaces of the engagement member, respectively.

8. The latching device according to claim 7, wherein the first end of the spring is coupled to the second engagement portion of the bell crank and wherein the second end of the spring is coupled to the engagement member.

9. The latching device according to claim 2, wherein the engagement member further comprises an elongated engagement arm and a transverse end that transversely extends with respect to the elongated engagement arm.

10. The latching device according to claim 9, wherein the transverse end of the engagement member comprises an inner engagement surface that transversely extends relative to the first engagement surface and wherein rotation of the bell crank away from the latched position initially causes the inner engagement surface to separate from the retainer as the first engagement surface slides along and continues to abut the retainer and thereafter causes the engagement member, including the inner engagement surface and the first engagement surface, to rotate away from the retainer towards the unlatched position.

11. The latching device according to claim 10, wherein rotation of the bell crank towards the latched position initially causes the engagement member, including the inner engagement surface and the first engagement surface, to translate about the bell crank axis of rotation towards the retainer until the first engagement surface abuts the retainer and thereafter move towards and engages with the retainer.

12. The latching device according to claim 2, further comprising a handle that is coupled to the bell crank and rotatable about the bell crank axis of rotation; wherein rotation of the handle about the bell crank axis of rotation causes rotation of the bell crank.

13. The latching device according to claim 12, further comprising a handle retainer assembly that couples the handle to the bell crank such that the handle is movable into and between a rotationally fixed position in which the handle is prevented from rotating about the bell crank axis of rotation and a rotatable position in which the handle is rotatable about the bell crank axis of rotation.

14. The latching device according to claim 13, wherein the handle retainer assembly further comprises a handle shaft about which the handle is pivotable between the rotationally fixed position and the rotatable position, wherein the handle shaft extends transversely to the bell crank axis of rotation.

15. The latching device according to claim 14, wherein the handle retainer assembly further comprises a handle retainer that houses the handle in the rotationally fixed position, wherein the handle is pivoted about the handle pivot shaft to remove the handle from the handle retainer.

16. The latching device according to claim 15, further comprising a clevis housing that supports the handle pivot shaft, wherein the clevis housing comprises clevis ears that have throughbores that receive the handle pivot shaft and wherein the handle further comprises handle ears that have throughbores that also receive the handle pivot shaft to thereby pivotably couple the handle to the clevis housing.

17. The latching device according to claim 16, further comprising a bell crank pivot shaft that extends along the bell crank axis of rotation and connects the bell crank to the clevis housing such that the handle, clevis housing and bell crank rotate together about the bell crank axis of rotation as the handle is rotated about the bell crank axis of rotation.

18. A latching device for a cowl on an outboard marine engine, the cowl having first and second cowl portions that are separated from each other in an open cowl position and that are latched together by the latching device in a closed cowl position, the latching device comprising:

a retainer adapted to be fixed to the first cowl portion;

a latch adapted to be fixed to the second cowl portion;

wherein the latch is rotatable into and between a latched position in which the latch is latched to the retainer and an unlatched position in which the latch is unlatched from the retainer;

wherein the latch comprises an engagement member, a bell crank, and a spring that is coupled to the bell crank and the engagement member;

wherein rotation of the latch towards the latched position causes the engagement member to engage the retainer, and wherein further rotation of the latch towards the latched position causes the bell crank to rotate with respect to the engagement member, which causes the engagement member to latch to the retainer;

wherein rotation of the latch away from the latched position causes the bell crank to rotate the engagement member, which causes the engagement member to unlatch from the retainer, and wherein further rotation of the latch away from the latched position causes the engagement member to separate from the retainer; and wherein rotation of the bell crank with respect to the engagement member generates an overcenter force on the engagement member that facilitates latching and unlatching of the engagement member and the retainer.

19. The latching device according to claim 18, wherein the bell crank rotates about a bell crank axis of rotation; wherein the engagement member rotates about an engagement member axis of rotation; and wherein the engagement member axis of rotation and the bell crank axis of rotation are parallel to each other and are laterally spaced apart from each other;

wherein movement of the bell crank with respect to the engagement member acts against the spring as the bell crank passes by a centered position to an overcenter position wherein separating forces on the first and second cowl portions retain the latch in the latched position; and wherein the spring acts to retain the bell crank and engagement member in a rotational position with respect to each other when the latch is in the unlatched position.

20. A cowl on an outboard marine engine, the cowl comprising:

first and second cowl portions that are separated from each other in an open cowl position and that are latched together by the latching device in a closed cowl position a retainer fixed to the first cowl portion;

a latch fixed to the second cowl portion;

wherein the latch is movable into and between a latched position in which the latch is latched to the retainer and an unlatched position in which the latch is unlatched from the retainer;

wherein the latch comprises an engagement member, a bell crank, and a spring that is coupled to the bell crank and the engagement member;

wherein movement of the latch towards the latched position causes the engagement member to engage the retainer, and wherein further movement of the latch towards the latched position causes the bell crank to move with respect to the engagement member, which causes the engagement member to latch to the retainer;

wherein movement of the latch away from the latched position causes the bell crank to move the engagement member, which causes the engagement member to unlatch from the retainer, and wherein further movement of the latch away from the latched position causes the engagement member to separate from the retainer; and wherein movement of the bell crank with respect to the engagement member generates an overcenter force on the engagement member that facilitates latching and unlatching of the engagement member and the retainer.

* * * * *